US012226685B2

(12) United States Patent
Johnson

(10) Patent No.: US 12,226,685 B2
(45) Date of Patent: Feb. 18, 2025

(54) ACTIVITY RING HAVING ONE OR MORE BALL

(71) Applicant: Emeka Johnson, Durham, NC (US)

(72) Inventor: Emeka Johnson, Durham, NC (US)

( * ) Notice: Subject to any disclaimer, the term of this patent is extended or adjusted under 35 U.S.C. 154(b) by 330 days.

(21) Appl. No.: 17/706,568

(22) Filed: Mar. 28, 2022

(65) Prior Publication Data

US 2023/0302342 A1 Sep. 28, 2023

(51) Int. Cl.
*A63B 71/06* (2006.01)
*A63B 21/065* (2006.01)

(52) U.S. Cl.
CPC ..... *A63B 71/0622* (2013.01); *A63B 21/065* (2013.01); *A63B 2071/0625* (2013.01); *A63B 2209/08* (2013.01); *A63B 2225/74* (2020.08)

(58) Field of Classification Search
CPC ..... A63B 71/0622; A63B 21/065; A63B 2071/0625; A63B 2209/08; A63B 2225/74; A63B 19/04; A63B 21/0608; A63B 2208/12
See application file for complete search history.

(56) References Cited

U.S. PATENT DOCUMENTS 3,708,164 A * 1/1973 Griffin ..... A63B 23/14 482/46
3,758,981 A * 9/1973 Hlasnicek ..... A63F 7/3622 273/109
3,867,787 A * 2/1975 Weinger ..... A63H 33/02 446/274
4,356,915 A * 11/1982 Phillips ..... B65D 85/58 224/919
4,429,487 A * 2/1984 Taylor ..... A63B 67/08 446/28
4,480,831 A * 11/1984 Muller-Deinhardt ..... A63B 21/0608 446/236
4,632,391 A * 12/1986 Orak ..... A63B 21/0608 482/44
D301,510 S * 6/1989 Orak ..... D21/684
D312,855 S * 12/1990 Silvey ..... D21/662
D335,553 S * 5/1993 Conner ..... D30/160
5,269,261 A * 12/1993 McCance ..... A01K 15/024 119/706
5,351,650 A * 10/1994 Graves ..... A01K 15/025 473/594
5,517,948 A * 5/1996 Udelle ..... A01K 15/025 119/706
5,674,162 A * 10/1997 Ellingson ..... A63B 21/0004 482/44
5,692,944 A * 12/1997 Pellicone ..... A63B 21/0004 273/109
5,809,938 A * 9/1998 Baiera ..... A01K 15/025 119/707
D405,563 S * 2/1999 Baiera ..... D30/160
(Continued)

*Primary Examiner* — Garrett K Atkinson

(57) ABSTRACT

A device for exercise or entertainment. The device comprises body that is generally a ring with a cavity. The cavity may hold one or more spherical object, such as metal or plastic balls, within. An exterior portion of the device is clear or translucent, allowing the balls to be observed. A person engages in exercise by wearing the device on an arm or leg and moving the limb causing the balls within the device to move around the cavity of the device. The device may include an opening to allow a person to add or remove balls from the interior of the device.

13 Claims, 14 Drawing Sheets

(56) References Cited

U.S. PATENT DOCUMENTS 6,099,444 A * 8/2000 Domenge ..... A63B 21/0608 482/110
6,450,928 B1 * 9/2002 Larkins, Jr. ..... A63B 21/0608 482/106
6,488,613 B1 * 12/2002 Domenge ..... A63B 21/22 482/148
6,500,102 B1 * 12/2002 Domenge ..... A63B 15/005 482/148
6,776,742 B2 * 8/2004 Domenge ..... A63B 21/0608 482/148
7,846,076 B2 * 12/2010 Salzwimmer ..... A63B 21/0624 482/44
8,814,765 B2 * 8/2014 Bernstein ..... A63B 21/4035 482/110
10,918,898 B1 * 2/2021 Palacios ..... A63B 21/0603
11,123,648 B1 * 9/2021 Denoual ..... A63H 33/00
11,131,344 B1 * 9/2021 Roffe ..... F16C 33/3875
11,517,783 B2 * 12/2022 Hamady ..... A63B 21/4035
11,819,732 B1 * 11/2023 Wilson ..... A63B 23/12
2002/0155781 A1 * 10/2002 Lee ..... A63B 19/00 446/236
2003/0134727 A1 * 7/2003 Yu ..... A63B 23/03508 482/44
2005/0096200 A1 * 5/2005 Amann ..... A63B 21/0602 482/110
2005/0192170 A1 * 9/2005 Cleveland ..... A63B 23/03508 482/148
2008/0242508 A1 * 10/2008 Smith ..... A63B 21/4035 74/5.22
2009/0247375 A1 * 10/2009 Smith ..... A63B 21/22 482/110
2010/0190620 A1 * 7/2010 Chen ..... A63B 21/4009 482/110

* cited by examiner

ACTIVITY RING HAVING ONE OR MORE BALL

PRIORITY CLAIM

This application claims the benefit of U.S. Provisional Application No. 63/166,890, being filed on Mar. 26, 2021, which is hereby incorporated by reference in its entirety.

FIELD OF THE INVENTION

The present device relates to the field of the hula hoop or an activity ring. Specifically, the present device relates to the mini hula hoop or a small activity ring.

BACKGROUND OF THE INVENTION

Hula hoops have been around for centuries, and this popular item has been used by children as well as adults for fitness, acrobatics, gymnastics, and other uses. While there are many varieties of hula hoops on the market, a particular hula hoop may be the mini hula hoop used specifically for toning the arms. However, not as many hula hoop users prefer the mini hula hoop over the larger hula hoop for various reasons and another concern may be that the mini hula hoop may be used specifically for toning the arms, therefore there exists, the need for another device that can be used for toning the arms and toning the legs as well.

SUMMARY OF THE INVENTION

Recognizing the limitations in the prior art, it is desirable for a device to provide an easier method and exciting experience to tone the arms and legs. The enclosure defines a circular device, with an opening in the center and apertures at the top, sides, and bottom that contain one or more ball members placed on a toroidal course at the bottom of the device. Also, it can come without apertures at the top, sides, and bottom and contain one or more ball members.

In some embodiments, an exercise or entertainment device includes a body having a substantially circular shape and a cavity therein. The cavity is configured to contain at least one generally spherical objects therein. At least one portion of the body is configured to allow a person to see an interior of the cavity and the at least one generally spherical object therein. The cavity is shaped so that the at least one generally spherical object may travel throughout the cavity and the at least one generally spherical object moves within the cavity when the body is spun, rotated, or twirled.

In at least one embodiment, there are at least two generally spherical objects contained within the cavity and each object varies in at least one of color, weight, material, width, and sound generated when moved.

In at least one embodiment, the at least one generally spherical object emits light when the object is moved.

In at least one embodiment, the body has a first end having a first attachment device and a second end having a second attachment device, wherein the first attachment device and the second attachment device are configured to connect to each other and close the body.

In at least one embodiment, when the first attachment device is not attached to the second attachment device the body has an opening therein configured to allow a person to place the device on body part or another object.

In at least one embodiment, the body part is an arm or leg.

In at least one embodiment, the cavity is generally cylindrical in shape.

In at least one embodiment, an exterior of the body includes an engagement portion configured to engage with a second device, wherein the second device is detachably secured to the body.

In at least one embodiment, the engagement portion is configured so that the second device is secured to the body via frictional force.

In at least one embodiment, the engagement portion includes a protrusion which engages with a groove in the second device.

In at least one embodiment, the engagement portion includes a magnetic member that magnetically attracts at least a portion of the second device.

In at least one embodiment, the body comprises an opening that can be opened an closed, wherein the opening is configured that when the opening is opened on or more generally spherical objects may be placed in the cavity or removed from the cavity.

In at least one embodiment, a wire located within the cavity, wherein the wire is configured to engage with one or more spherical objects.

In at least one embodiment, each of the one or more generally spherical objects contains a hole running through a central axis, wherein each of the generally spherical objects is secured inside the cavity via the wire and the hole.

In at least one embodiment, the device further includes a cuff, wherein the cuff is configured to be worn a body part such as an arm or leg, wherein the body of the device opens to enable the device to put around the cuff, and when the body of the device is closed the cuff keeps the device snug on the arm or leg.

In another embodiment, a method of exercising includes providing a device having a body with a substantially circular shape and a cavity therein, wherein the cavity is configured to contain at least one generally spherical objects therein, wherein at least one portion of the body is configured to allow a person to see an interior of the cavity and the at least one generally spherical object therein, wherein the cavity is shaped so that the at least one generally spherical object may travel throughout the cavity and the at least one generally spherical object moves within the cavity when the body is spun, rotated or twirled. The device is fit around a body part, and the body part is moved so that each of the generally spherical objects rotates within the device.

In at least one embodiment, fitting the device on a body part includes placing a cuff on the body part and fitting the device on the cuff, wherein the cuff is configured to be worn a body part such as an arm or leg, wherein the body of the device opens to enable the device to put around the cuff, and when the body of the device is closed the cuff keeps the device snug on the arm or leg.

In at least on embodiment, the user places their arm, leg, or object through the center of the device to manually rotate and spin one or more balls around the course. The user can add additional, identical rings by vertically stacking and attaching the ring to another ring, as well as adding and attaching outer circular attachments increasing the device's width. The user may also be able to add more balls to the rings to add more resistance and variety.

The balls may consist of an interior flashing, glowing, or steady light or can also come without a light. The balls can come in a variety of colors, weights, and materials.

The ring can internally and externally light up, glow, or not light up and come in a variety of colors and materials, and sound effects or not have any sound effects. The outer circular attachments can light up, glow, and not light up and come in a variety of colors and materials.

The ring also comes with a cylindrical stand that lights up, glows, and also may not light that fits through the center of the ring utilized as a storage for the ball members having a handle at both ends.

These aspects of the invention are not meant to be exclusive and other features, aspects, and advantages of the present invention will be readily apparent to those of ordinary skill in the art when read in conjunction with the following description, appended claims, and accompanying drawings.

BRIEF DESCRIPTION OF THE DRAWINGS

The accompanying drawings are included to provide a further understanding of the device and are incorporated in and constitute a part of the specification, illustrate embodiments of the device, and together with the description explain the principles of the device. The drawings are not necessarily to scale, emphasis instead being placed upon illustrating the preferred embodiments.

DETAILED DESCRIPTION OF THE DRAWINGS

Various embodiments and aspects of the devices will be described with reference to details discussed below, and the accompanying drawings will illustrate the various embodiments. The following description may be presented to enable any person skilled in the art to make and use the device. The following description and drawings are illustrative of the device and are not to be construed as limiting the device. Numerous specific details are described to provide a thorough understanding of various embodiments of the present device. Descriptions of specific embodiments or applications are provided only as examples. Various modifications to the embodiments will be readily apparent to those skilled in the art, and general principles defined herein may be applied to other embodiments and applications without departing from the spirit and scope of the device. However, in certain instances, well-known or conventional details are not described in order to provide a concise discussion of embodiments of the present devices.

FIGS. 1-5 illustrate perspective views of the activity ring according to one embodiment of the present device. The activity ring 10 has housing 20 that is generally circular. The interior of the housing includes a cavity, or hollow portion that extends throughout the housing. One or more generally spherical device 12 (hereinafter "ball") may be enclosed within the housing 20. The housing is made of a material such as plastic or metal. The cavity is generally circular shaped and may be bounded by a generally flat upper top wall. The top wall forms and defines a toroidal shaped track about which the balls 12 may be located and travel.

Figure 4:
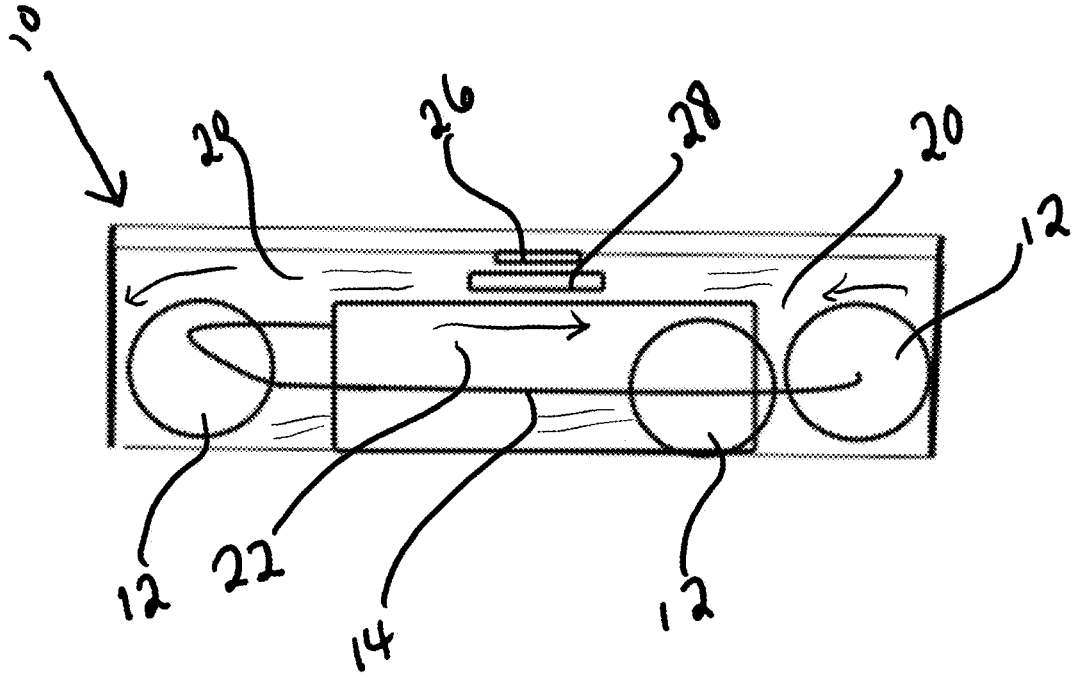
FIG. 4 illustrates a plan view of the activity ring.
Figure 5:
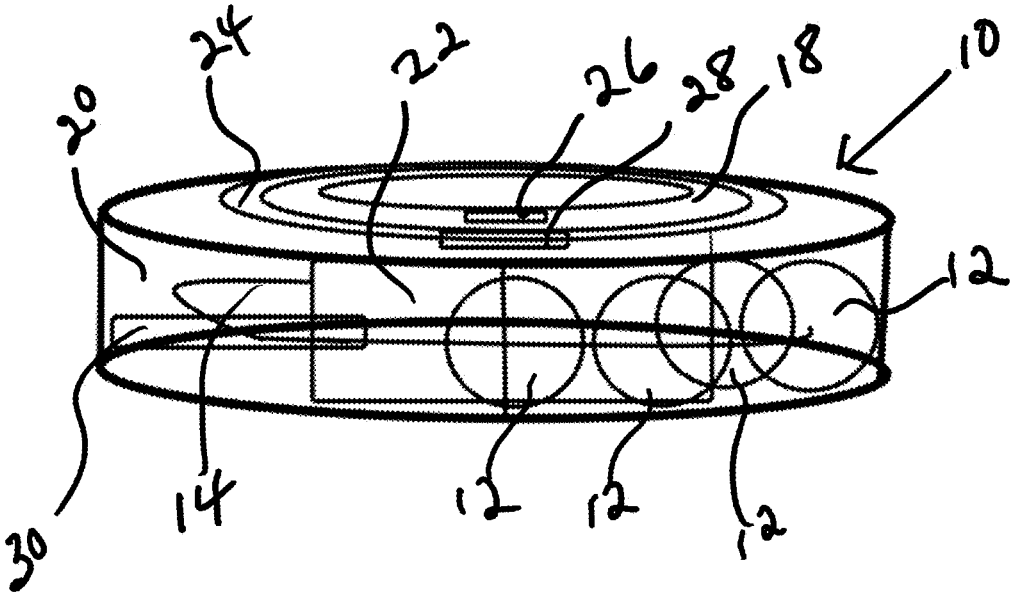
FIG. 5 illustrates a side view of the activity ring.

In FIG. 4, The ball 12 can go in both directions depending on the direction the ring 10 is turned. The ball 12 goes around a cylindrical compartment 22 which is hollow in the middle. The ball 12 is placed on a track 16. The track 16 is located at the top and bottom portions inside the ring 10. The ball 12 is also held by a circular rod 14 going through it as seen in FIG. 4. The rod 14 can be made of metal, plastic, but is not limited to these materials and could be made from any material strong and flexible enough to hold and guide the ball 12.

Figure 12:
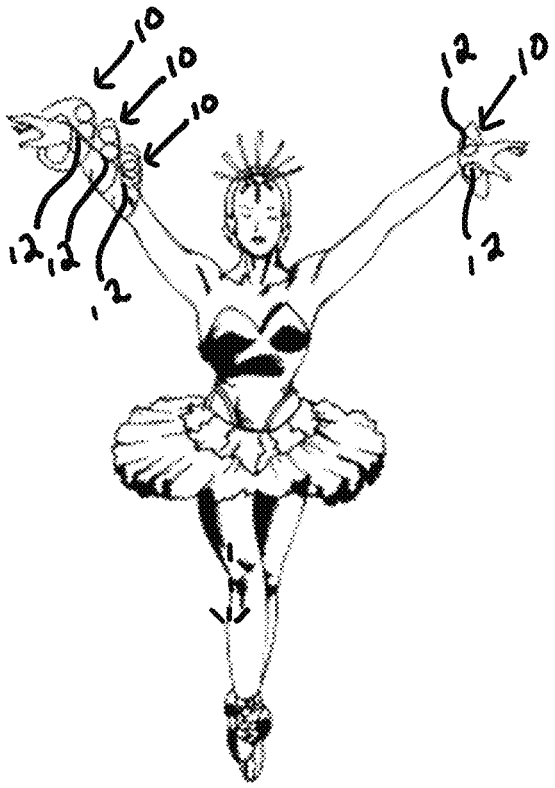
FIG. 12 is a view of a user using the rings on the arms.
Figure 13:
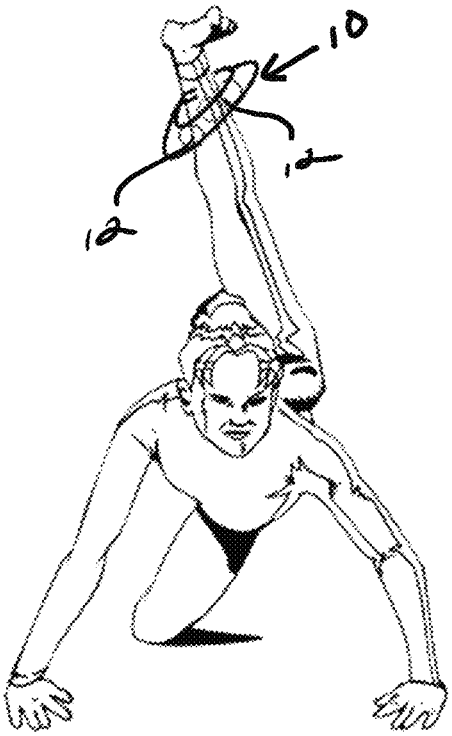
FIG. 13 is a view of a user using the rings on the legs.

The middle of the cylindrical compartment 24 is hollow and has a soft lining so that the user can fit their body part comfortably in the middle of the ring 10 as seen in FIG. 12 and FIG. 13. The material of the lining can be made from leather, plush, but is not limited to these materials and could be made from any material needed for comfort and durability.

Inside the cylindrical compartment 24, an optional inner removable ring 18 or cuff that is lined also and has a hollow part in the middle where the body part would fit snugger and prevent the ring 10 from sliding off. The removable ring 18 can be made from leather, fleece, plush, cloth, plastic, or fabric, but is not limited to these materials and could be made from any material needed for comfort.

To use the device, the user inserts a body part in the ring 10 and moves the body part in a circular motion of 360 degrees, either left or right, which will move the balls 12 around the cylindrical compartment 24. The ball's 12 internal light 12A would turn on and flash or remain steady (not flashing) while the ball 12 is moving. The user would have to focus on spinning the ball or balls 12 completely around the cylindrical compartment 24 in the ring 10. The ball 12 can also be a weighted ball or have a weight inside to add resistance.

Figure 6:
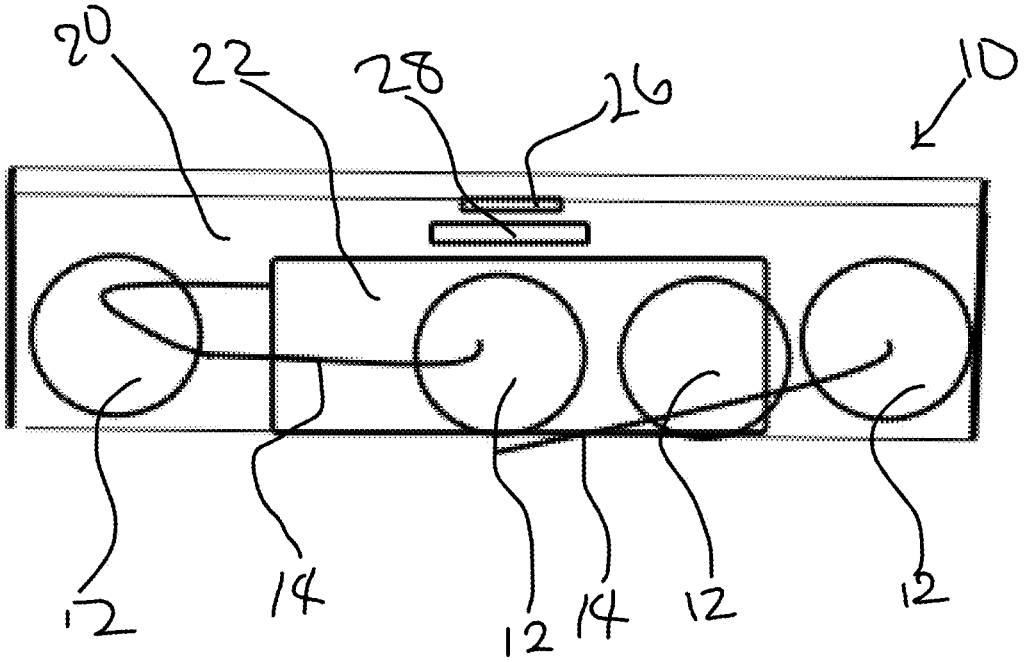
FIG. 6 illustrates a view of the unlocked band of the activity ring.
Figure 7:
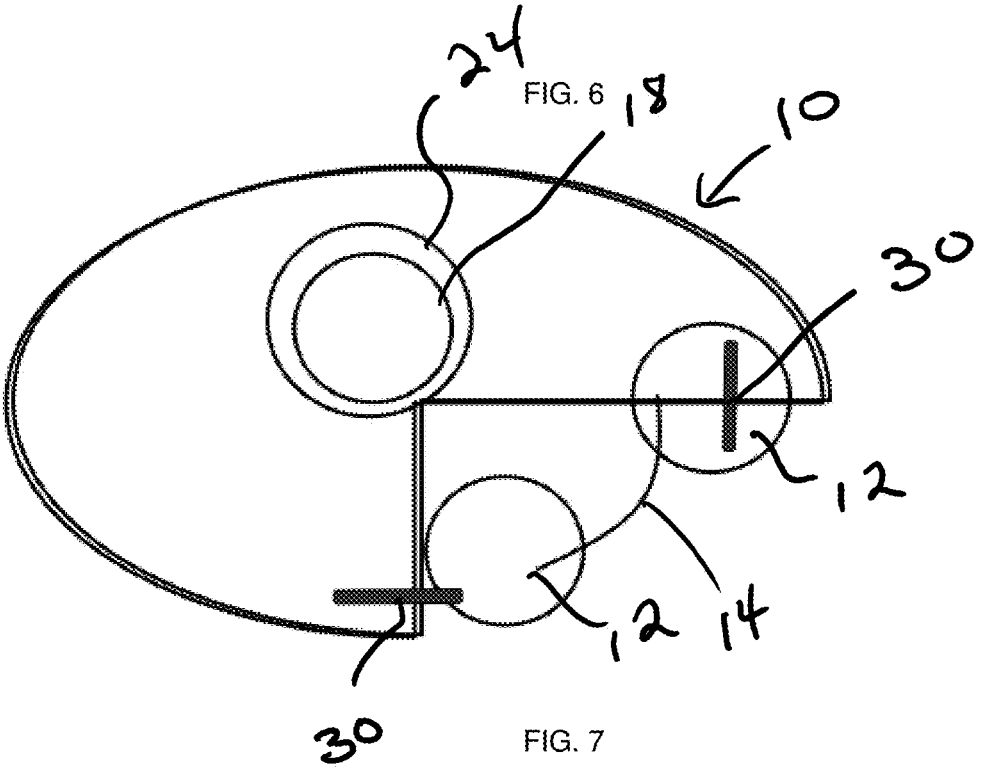
FIG. 7 illustrates a view of the unlocked band of the activity.
Figure 8:
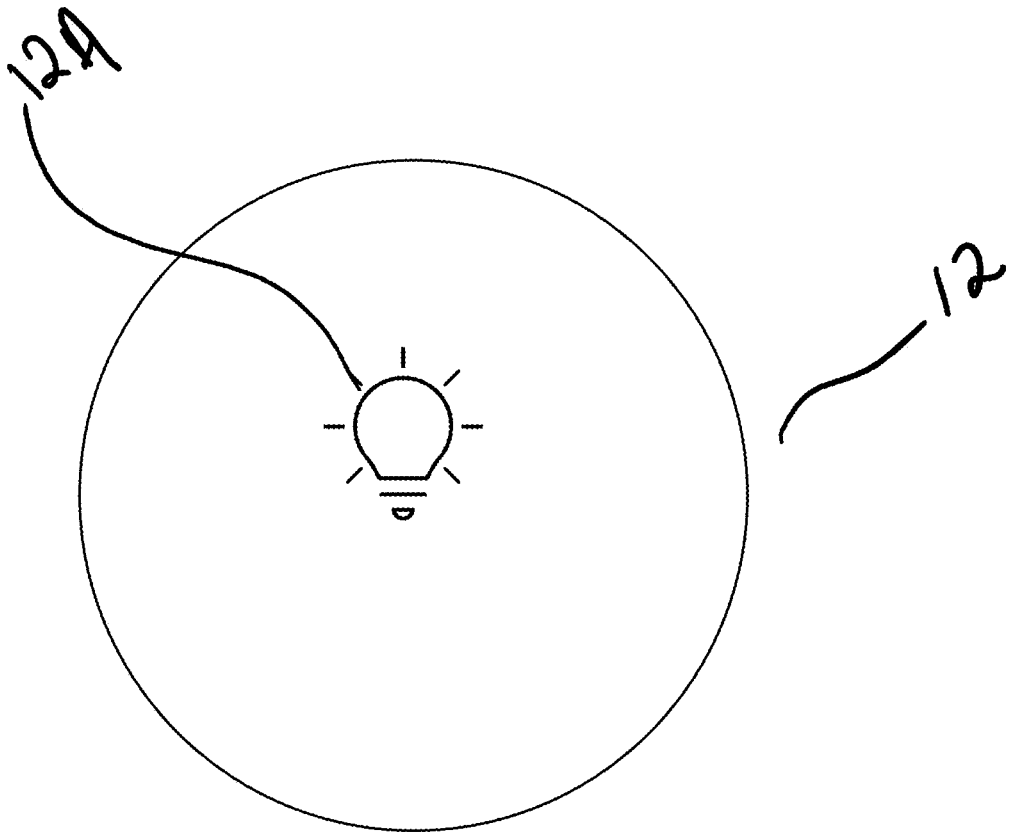
FIG. 8 illustrates a view of the ball member.
Figure 9:
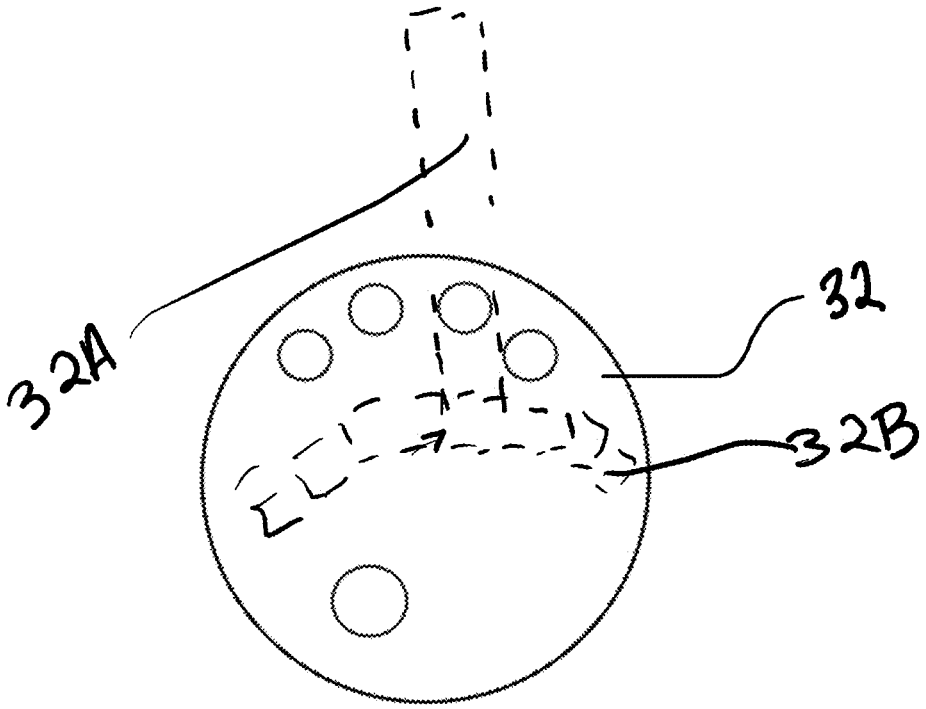
FIG. 9 illustrates a top view of a removable ring cover.
Figure 10:
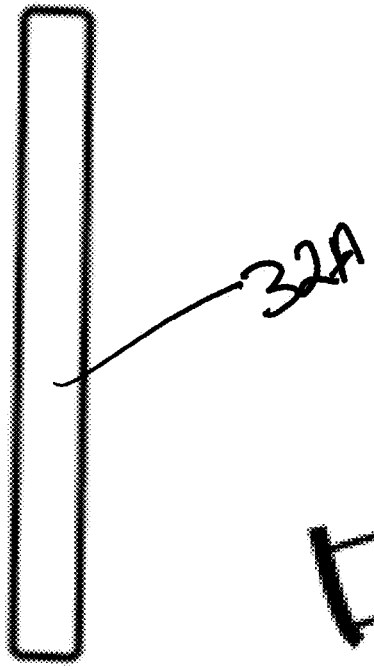
FIG. 10 is a view of a removable pole or wire.
Figure 11:
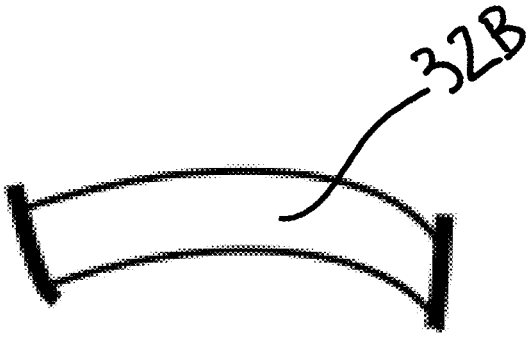
FIG. 11 is a view of the removable strap.

FIG. 7, 30 shows a latch or slide lock for the ring 10. The latch allows the ring 10 to unlock and open to the side. In a preferred embodiment, the ring 10 does not open more than an inch and is added to allow the user to free their body part if needed. The band 14 is still attached when the ring's 10 slide lock is unlocked and opened represented in FIG. 7. The band 14 must be detached separately. FIG. 6 shows the band 14 which can be detached in one place once the latch 30 is unlocked so that the user can remove and add balls inside the ring.

Figure 3:
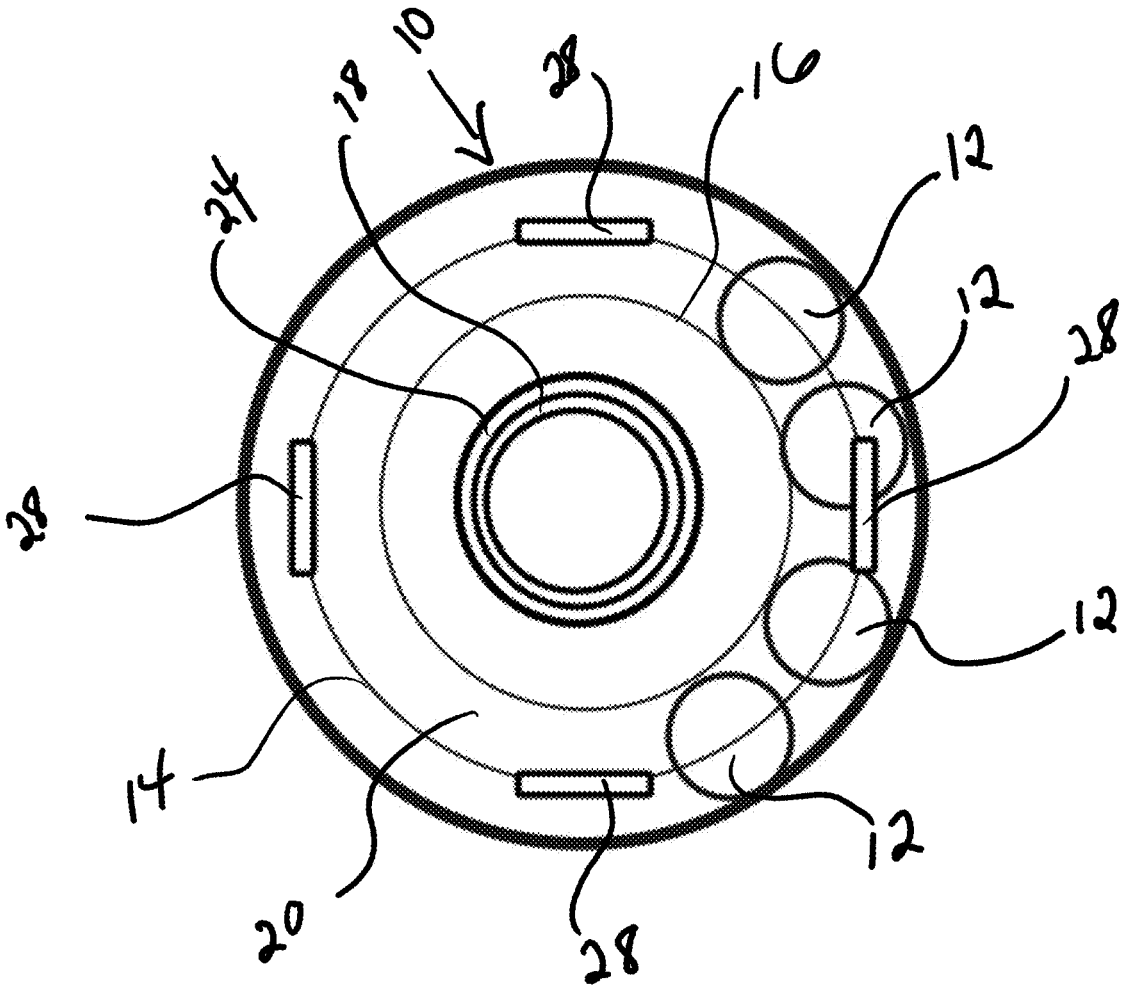
FIG. 3 illustrates a bottom view of the activity ring.

The ring 10 can attach and detach to another ring 10 by using the slide locks located on top and at the bottom of the ring 10 represented in FIG. 3, element 28. Multiple rings 10 can be placed together on the users arm or leg as shown in FIG. 12 and FIG. 13.

Figure 1:
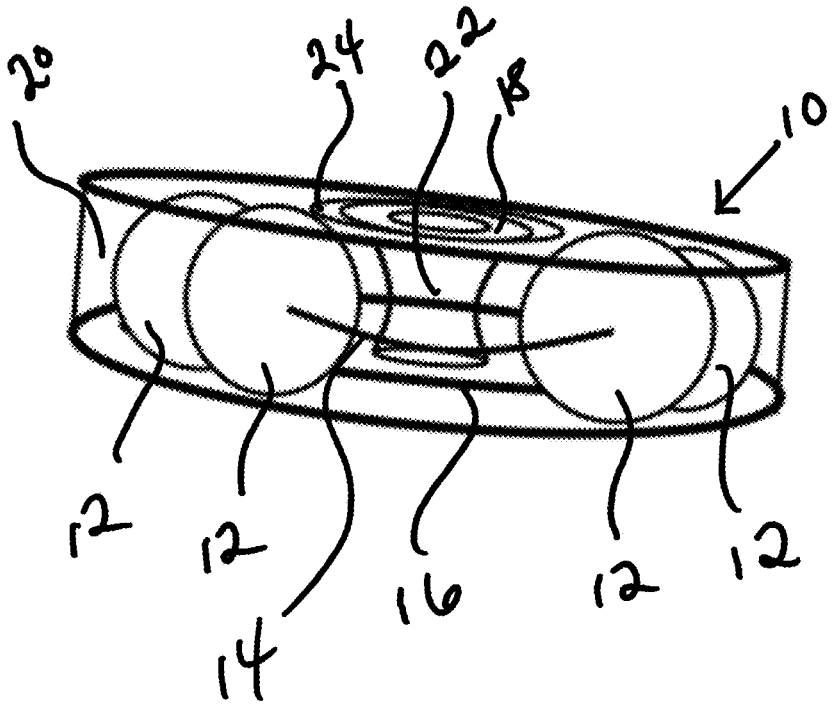
FIG. 1 illustrates a perspective view of the activity ring according to one embodiment of the present device.
Figure 2:
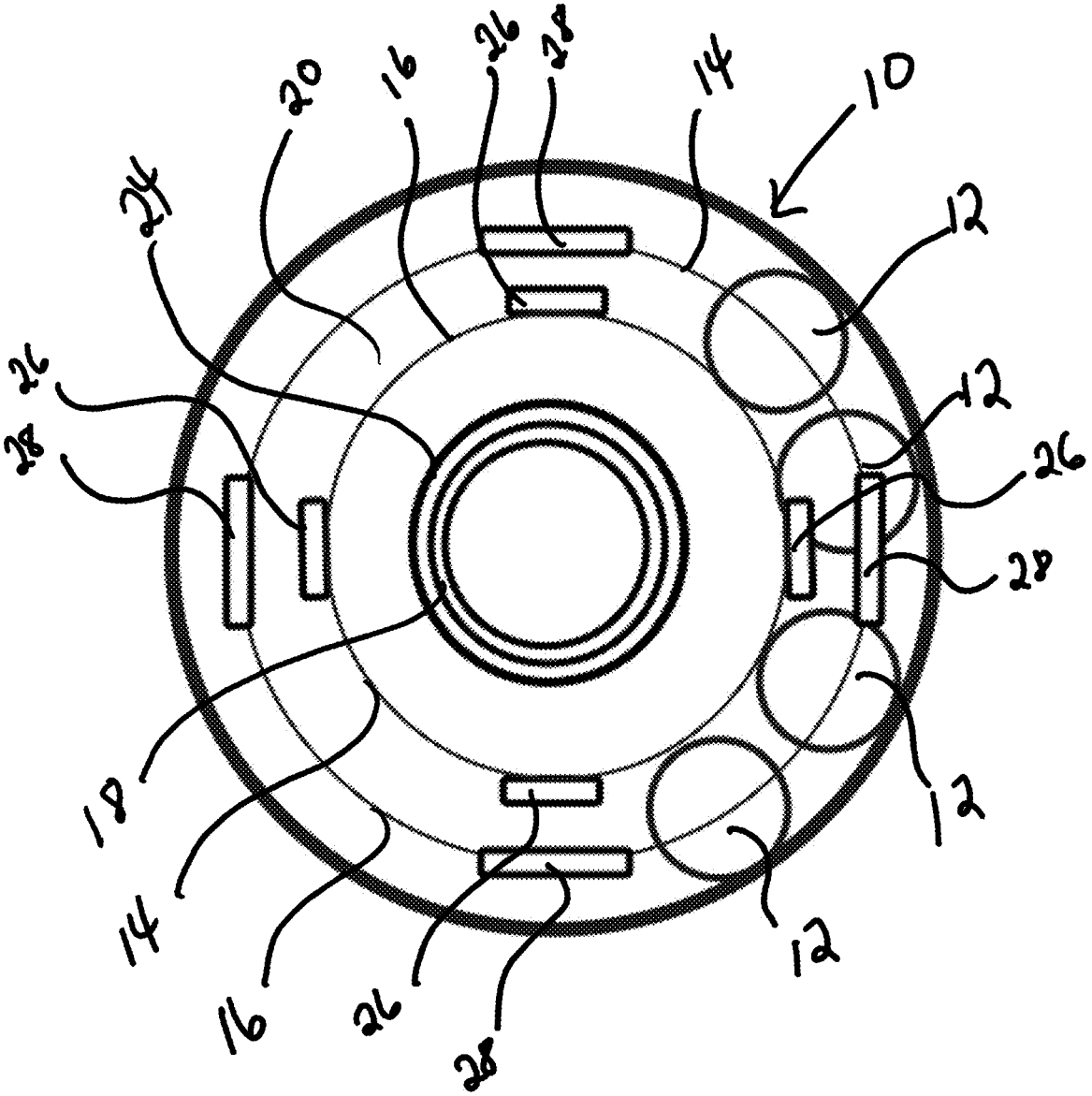
FIG. 2 illustrates a top view of the activity ring.

The ring 10 comes with an additional cover 32 that is removable and attaches to slide locks 26 located at the top of the ring 10, represented in FIG. 2, so that the ring 10 can be used in different ways and is more comfortable to the user. The attachment has five holes for placing the users fingers and a removable and adjustable strap 32B. The strap 32B can be made from Velcro but is not limited to this material and can be made from any material that is comfortable to the user and holds the weight of the ring 10 along with the weight of the balls 12. The attachment also comes with a pole 32A, no longer than a foot that can be attached to the cover 32. The pole 32A can be made from plastic but is not limited to this material and can be made from any material strong enough to support the weight of the ring 10 along with the weight of the balls 12. The ring 10 can come in various sizes, colors, patterns, and weight. The ball 12 can also come in various sizes, patterns, and weight.

In one embodiment, the housing consists of a generally circular top, generally circular bottom, and a sidewall. The top and sidewall are formed of a single member with a rounded transition portion. At least one portion of the housing is formed of a transparent material. In one embodiment, at least the transition portion is formed of a transparent material. In another embodiment, the entire member forming the top and sidewall are formed of a transparent material.

In one embodiment, one or more openings are formed in the transition portion. The openings are a size that is suitable to view the balls located inside the ring while maintaining the balls inside the ring. The top wall, bottom wall, and sidewall may be formed of the same material, such as plastic or metal.

In one embodiment, the member forming the top and the sidewall is removably secured to an upwardly extending flange around the edge of the bottom in a "snap" type fit. In another embodiment the top, sidewall, and bottom are formed of a unitary piece.

In the embodiments discussed above, the ring according to the present device, conveniently takes the form of toroidal enclosure, configured to rest with its central axis which is substantially perpendicular to the compartment. The enclosure includes a flat or planar ring-shaped bottom member and a mating annular cover member having a U-shaped shaped cross section. The bottom member may be formed of metal, composition board, plastic or the like and may be semi-rigid in nature. In one embodiment, the bottom member may be molded from any suitable known plastic, such as polyethylene, polystyrene, polyamide, polyester and polyurethane plastics and may be semi-rigid in nature. The cover member may be made of clear transparent plastic materials of any of the types may be closed.

In one embodiment, the inner periphery of the bottom member are defined by a pair of upwardly extending continuous ridges and concentrically spaced from each other to form an annular slot therearound. The outer periphery of the bottom member are similarly defined by a pair of upwardly extending circumferential ridges and spaced to form another slot.

The mating cover member may be circular, arched, and may be provided with a pair of concentric edges and may be posed to fit in the slots at the inner and outer perimeters of the bottom members respectively. Peripheral edges may be slightly enlarged so that in assembly with bottom member, the cover member fits snugly and may be frictionally held therein. when the bottom member and the cover are assembled, they form a predefined course or raceway for the balls.

In one embodiment, the cover member is provided with a plurality of portal openings disposed in its side wall, spaced circumferentially to align with the sills. In an alternative embodiment, the cover member is provided with one or more opening in its top, which are oblong rather than arched to provide a view of the balls or access to the balls.

In accordance with the present device, both the cover and bottom members may be made from clear plastic although it may be preferred that the bottom member be made of a brightly colored plastic.

Although the bottom and cover member 12 and 14 are shown as being ring shaped, having central openings connected to each other by the functional engagement of the ridges and edges, neither the ring shaped form or frictional connection may be critical. The cover and bottom members be oval, oblong, rectangular or provided in a three dimensional path, such as a loop, all intended to have a predetermined raceway and they may be connected by other means such as gluing, heat sealing or the like.

Figure 14:
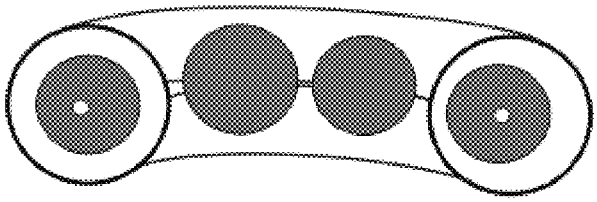
FIG. 14 illustrates an interior view showing balls inserted onto a pole or wire.

FIG. 14 illustrates an embodiment in which a pole or wire is placed inside the ring. Each of the balls has a hole, and the balls are inserted onto the wire when placed inside the ring. In one embodiment, the wire is configured to allow the balls to rotate freely throughout the entirety of the ring. In another embodiment, the wire includes one or more bumps that act to limit movement of the balls. The bumps are each sized so that a user more force a ball pass the bump, but the balls are stopped by the bump when enclosed within the ring. In alternative embodiment, one or more stopper, such as rubber or plastic plug, is placed on the ring to stop the balls from moving along the wire.

Figure 15:
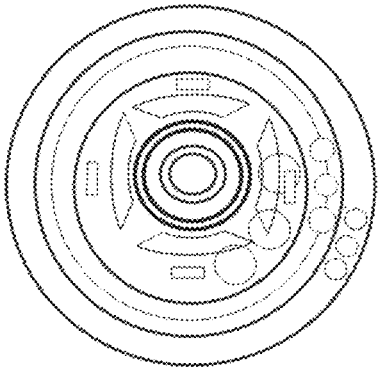
FIG. 15 illustrates an embodiment in which two activity rings are connected.

FIG. 15 discloses an embodiment where two rings are connected to one another. A first ring has engagement portion on the outer wall configured to connect to an outer wall of a second ring. In one embodiment, the engagement portion is a surface having a high surface tension causing the two rings to be held together via frictional forces. In an other embodiment, one ring includes a projection and the other ring includes a slot, wherein the slot engages with the projection to hold the two rings together. In another embodiment, the engagement portion includes a magnet or magnetic material, and the the two rings are held together via magnetic attraction.

Figure 16A:
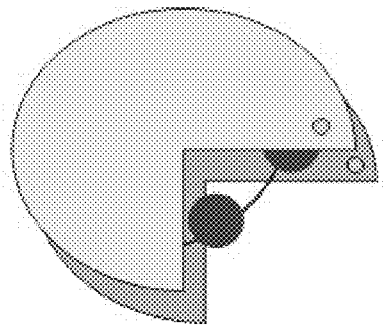
FIG. 16A illustrates an activity ring in an open state.
Figure 16B:
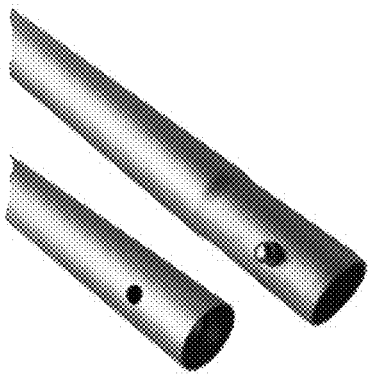
FIG. 16B illustrates a connection device on each end of the activity ring for closing the ring.

In one embodiment, the ring may not be opened. In another embodiment, the ring may be opened to help a user wear or remove the ring, or to add a remove balls to the interior of the ring. This is shown in FIGS. 16A,B. When opened, the ring has a first end and a second end. The first end has a first engagement portion and the second end has a second engagement portion. In the illustrated embodiment one engagement portion comprises on or more holes and the other engagement portion comprises pins (or protrusions) that are configured to insert into the holes. When the user wishes to open the ring, the user merely pushes the pins in allowing the ring to be opened. In one embodiment, the pins also protrude into the interior of the housing, preventing the balls from falling out of the ring.

In an alternative embodiment, one end of the ring is tapered inward so that the one fits into the other end of the ring.

When the ring is opened, the wire may be removed by pulling one end of the wire out of the interior of the ring. Once the wire is removed, the user may add or remove balls as desired. This allows the user to easy arrange the balls in any desired combination.

Figure 17:
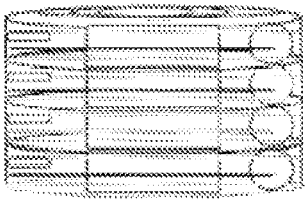
FIG. 17 illustrates an embodiment having decorative rings attached to the exterior of the activity ring.
Figure 18:
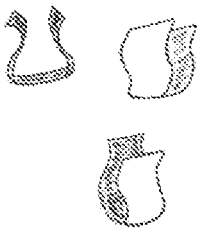
FIG. 18 illustrates clips used in the embodiment shown in FIG. 17.

In one embodiment, shown in FIG. 17, decorative rings are removably attached to an exterior of the ring. The decorative rings may be attached via clips shown in FIG. 18. In a preferred embodiment, at least one of the decorative rings light up such as ring of LED elements or a glow ring. The decorative rings are various colors as desired by the user.

In one embodiment, the activity ring housing includes two or more interior chambers. Each of the interior chambers is substantially cylindrical and configured to hold on or more balls therein. This is shown in FIG. 17.

Figure 19:
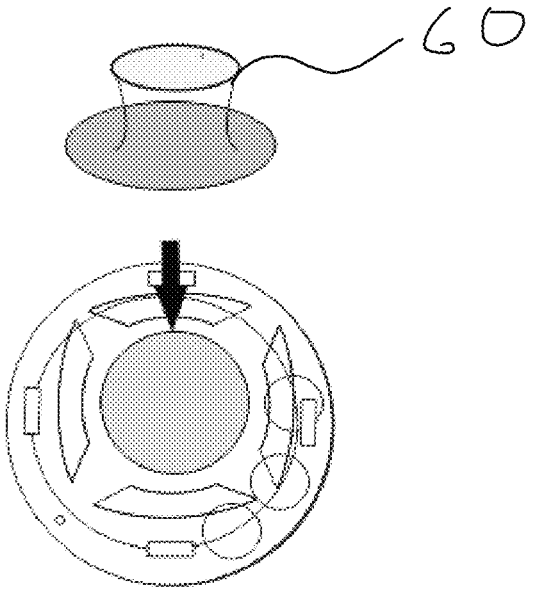
FIG. 19 illustrates a handle that is attachable to the activity ring.

FIG. 19 illustrates a handle 60 that is attachable to the activity ring. The handle 60 has a bottom that is generally circular and attaches to the exterior of the activity ring. The user may hold the handle and move the activity ring as desired. In an alternative embodiment, a top of the handle may open revealing a hollow cavity, and the hollow cavity can be used to store balls. The entire handle or just the top portion may be made of a clear, opaque, or translucent material, allowing a user to see any balls stored within the handle.

In alternative embodiment, the handle 60 has a base that is larger than interior diameter of the activity ring. The body of the handle is shaped so that the activity ring my slide down the body of the handle and rest on the bottom portion of the handle.

A method of exercising a human body, the method comprising: providing a ring having a body portion adapted for receiving a limb of the human body, placing the ring on a limb, and moving the limb. The ring may be any of the rings described above so that when the user rotates or moves the limb, the one or more balls located within the ring move inside the ring. As described above, the balls may be one or more color, may light when moved, or make a sound when moved.

It may be to be understood, therefore, that numerous modifications of the device of this may be device may be made without departing from the spirit and scope of the embodiment described herein. Therefore, it may be to be understood that this device may be not to be limited to the described embodiments thereof, except as defined in the appended claims.

The foregoing descriptions of specific embodiments of the present device have been presented for purposes of illustration and description. They are not intended to be exhaustive or to limit the device to the various forms that may be disclosed, and obviously many modifications and variations are possible considering the above teaching. The embodiments were chosen and described in order to best explain the principles of the device and its practical application, to thereby enable others skilled in the art to best utilize the device and various embodiments with various modifications as are suited to the particular use contemplated. It may be intended that the scope of the device be defined by the Claims appended hereto and their equivalents. Therefore, the scope of the device may be to be limited only by the following claims.

While the principles of the preferred embodiments have been described herein, it is to be understood by those skilled in the art this description is made only by way of example and not as a limitation to the scope of the invention. Other embodiments are contemplated with the scope of the present invention in addition to the exemplary embodiments shown and described herein. Modifications and substitutions by one of ordinary skill in the art are considered to be within the scope of the present invention.

The invention claimed is:

1. An exercise or entertainment device comprising: a ring-shaped body having a cavity therein and a central aperture, wherein the cavity is configured to contain at least one generally spherical object therein, wherein at least one portion of the body is configured to allow a person to see an interior of the cavity and the at least one generally spherical object therein, wherein the cavity is shaped so that the at least one generally spherical object can travel throughout the cavity and the at least one generally spherical object moves within the cavity when the body is spun, rotated or twirled; and a cuff, wherein the cuff is configured to be worn about an arm or leg, wherein the body of the device opens to enable the device to be fitted around the cuff such that the cuff is disposed in the central aperture, and when the body of the device is closed, the cuff keeps the device snug on the arm or leg.

2. The device of claim 1, wherein there are at least two generally spherical objects contained within the cavity and each object varies in at least one of color, weight, material, width, and sound generated when moved.

3. The device of claim 1, wherein at least one generally spherical object emits light when the object is moved.

4. The device of claim 1, wherein the body has a first end having a first attachment device and a second end having a second attachment device, wherein the first attachment device and the second attachment device are configured to connect to each other and close the body.

5. The device of claim 1, wherein the cavity is generally cylindrical in shape.

6. The device of claim 1, wherein an exterior of the body includes an engagement portion configured to engage with a second device, wherein the second device is detachably secured to the body.

7. The device of claim 6, wherein the engagement portion is configured so that the second device is secured to the body via frictional force.

8. The device of claim 6, wherein the engagement portion includes a protrusion which engages with a groove in the second device.

9. The device of claim 6, wherein the engagement portion includes a magnetic member that magnetically attracts at least a portion of the second device.

10. The device of claim 1, wherein the body comprises an opening that can be opened and closed, wherein the opening is configured that when the opening is opened one or more generally spherical objects may be placed in the cavity or removed from the cavity.

11. The device of claim 1, further comprising a wire located within the cavity, wherein the wire is configured to engage with the one or more spherical objects.

12. The device of claim 11, wherein each of the one or more generally spherical objects contains a hole running through a central axis, wherein each of the generally spherical objects is secured inside the cavity via the wire and the hole.

13. The device of claim 1, wherein the cuff is configured to open so that a user may more readily place the cuff on the arm or leg.

* * * * *